US005687453A

United States Patent [19]

Megregian et al.

[11] Patent Number: 5,687,453

[45] Date of Patent: Nov. 18, 1997

[54] GROUNDING WASHER AND ARRANGEMENTS FOR CONDUCTIVE HINGE JOINTS

[75] Inventors: Richard Megregian, Farmington Hills; James E. Van Hout, Auburn Hills; John S. Latimer, III, Bloomfield Hills, all of Mich.

[73] Assignee: Chrysler Corporation, Auburn Hills, Mich.

[21] Appl. No.: 422,461

[22] Filed: Apr. 17, 1995

[51] Int. Cl.[6] ..... E05D 11/00

[52] U.S. Cl. ..... 16/221; 16/223; 16/386; 361/753; 439/927; 411/544; 411/156

[58] Field of Search ..... 16/1 R, 221, 223, 16/287, 288, 297, 302; 361/216, 217, 681, 753; 180/69.2, 69.21, 69.22, 69.23; 439/29–31, 927; 411/544, 546, 155, 156, 545; 403/70, 71

[56] References Cited

U.S. PATENT DOCUMENTS

| | | | |
|---|---|---|---|
| 779,751 | 1/1905 | Waitt | 411/155 |
| 1,959,982 | 5/1934 | Loeser | 361/217 |
| 2,747,166 | 5/1956 | Hoffarth | 439/927 |
| 2,836,688 | 5/1958 | Florschutz | 439/31 |
| 2,895,033 | 7/1959 | Favre | 439/31 |
| 2,994,907 | 8/1961 | Hammond | 16/288 |
| 3,054,137 | 9/1962 | Pulleyblank | 16/288 |
| 3,103,398 | 9/1963 | Phelps | 439/31 |
| 3,362,737 | 1/1968 | Cobb | 411/546 |
| 3,431,590 | 3/1969 | Anderson | 16/223 |
| 3,914,001 | 10/1975 | Nelson et al. | 339/14 |
| 4,135,694 | 1/1979 | Stegenga | 411/544 |
| 4,526,432 | 7/1985 | Cronin et al. | 439/927 |
| 4,734,994 | 4/1988 | Cusack | 33/361 |
| 4,827,378 | 5/1989 | Gillan et al. | 439/620 |
| 4,927,367 | 5/1990 | Salvagno | 439/92 |
| 4,943,247 | 7/1990 | Wise | 439/927 |
| 5,001,659 | 3/1991 | Watabe | 361/681 |
| 5,173,837 | 12/1992 | Blackwell et al. | 361/380 |
| 5,212,907 | 5/1993 | Sandt | 439/31 |

FOREIGN PATENT DOCUMENTS

| | | | |
|---|---|---|---|
| 1156224 | 5/1958 | France | 411/155 |
| 2551404 | 5/1977 | Germany | 439/31 |
| 63-163017 | 7/1988 | Japan | 16/273 |
| 133437 | 8/1929 | Switzerland | 411/544 |

OTHER PUBLICATIONS

U.K Patent Application No. 2,203,484 A; Pub. 19 Oct. 1988 Inventor: Prentler.

*Primary Examiner*—Chuck Y. Mah
*Assistant Examiner*—Donald M. Gurley
*Attorney, Agent, or Firm*—Thomas G. Pasternak

[57] ABSTRACT

Radio noise in an automotive vehicle is suppressed by grounding the hood of the automotive vehicle with a conductive washer. The conductive washer is concave and is disposed around a rivet used to pivot a hood hinge component to a body hinge component. When the rivet is set, the hinge components compress the washer so as to permanently load the washer to thereby ensure continuous grounding of the hood to the body. Preferably, the rivet is coated with a dry lubricant, such as TEFLON®, which does not flow away from the rivet to interfere with electrical contact between the washer and hinge components.

7 Claims, 3 Drawing Sheets

GROUNDING WASHER AND ARRANGEMENTS FOR CONDUCTIVE HINGE JOINTS

1. Field of the Invention

The present invention relates to grounding washers and arrangements for conductive hinge joints. More particularly, the present invention relates to a grounding washer configuration and arrangements for conductive hinge joints employed in automotive body structures.

2. Background of the Invention

In order to suppress engine and accessory noise in an automotive vehicle, the hood covering the engine compartment of the vehicle is grounded to the automotive body through a hinge which pivots the hood. Currently, a ground strap is used to ground the hood to the body. Ground straps have a number of problems including high cost, packaging concerns, and problems with durability and reliability.

It should be kept in mind that tens of millions of automotive vehicles have radios in which noise suppression is desirable. Consequently, tens of millions of ground straps are employed to ground hoods. When considering the number of automotive vehicles involved, the direct costs as well as the costs associated with durability and reliability are considerable. Accordingly, there is a need for a new way to ground automotive hoods which is less expensive to begin with, does not involve packaging concerns and is durable and reliable.

SUMMARY OF THE INVENTION

It is a feature of the present invention to provide a new and improved grounding washer structure and a new and improved arrangement for conductive hinge joints.

In accordance with one aspect, the present invention is directed to a washer for use in a conductive hinge to allow conduction of electrical potential between first and second hinge elements connected by a pin. The washer comprises generally annular skirt formed on the washer, the skirt being deflected away from a plane to form a concavity with a peripheral edge for engaging one of the hinged members. The washer also has an inner portion extending toward a through hole through in which the pin is received, the inner portion having a surface for engaging the second hinge component.

In accordance with another aspect, the present invention is directed to an arrangement for a conductive hinge joint wherein the hinge joint comprises first and second components which are to be electrically connected to one another proximate pivot holes through the hinge components joined by a connecting pin. The connecting pin is a rivet having a first head for abutting a first surface of the first hinge component and a second head for abutting a first surface of the second hinge component to hold the hinge components in pivotal relationship with respect to one another. The rivet includes a stop portion extending from the first head toward the second head for engaging the second hinge component to keep the first and second hinge components in spaced relation to one another while the rivet is set to form the second head. The rivet further includes a shank portion extending through the pivot hole in the second hinge component. A conductive washer is disposed around the rivet between the first and second hinge components. The conductive washer is spring loaded upon forming the second end of the rivet so as to be under a constant load to maintain electrical contact between the first and second hinge components.

In accordance with still another embodiment, an automotive vehicle having a radio includes a metal body having an engine compartment enclosed by a hood pivoted to the body with a metal hinge, the metal hinge including a first hinge component fixed to the hood and a second hinge component fixed to the body. The hinge components pivot with respect to one another about a pin received through openings in the hinge components. The improvement comprises a conductive element disposed between the hinge components and around the pin. The conductive element is loaded so as to be in constant contact with both hinge components to ground the hood to the automotive body so as to suppress noise in the radio which would occur if the hood were ungrounded.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
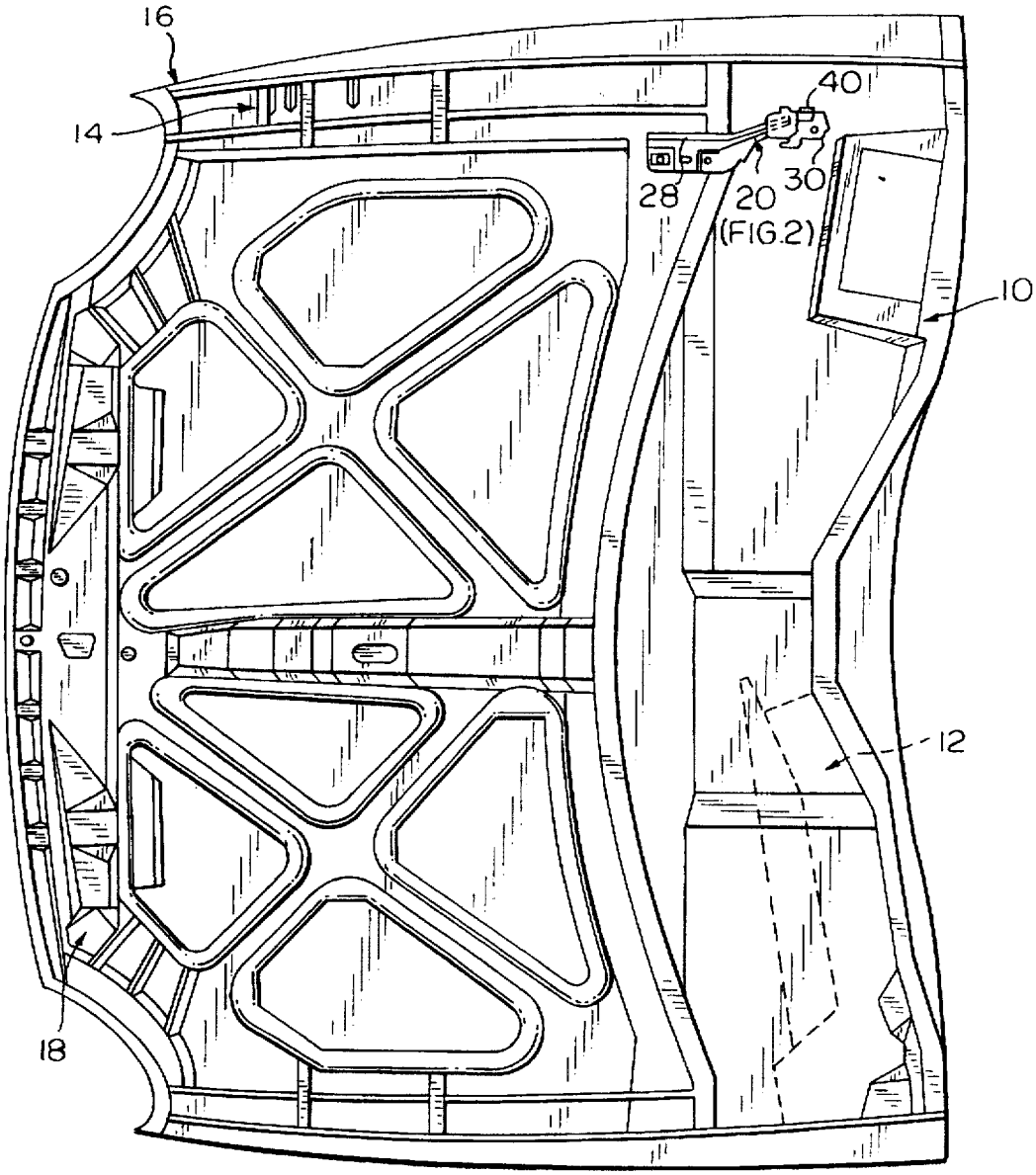
FIG. 1 is a top view, with portions deleted, of a portion of an automobile body showing a cowl, fender, load beam and hood.

Referring now to FIG. 1, there is shown portions of an automotive vehicle body including a cowl structure and dash panel 10 which houses a radio 12. A load beam 14 supports a fender 16 and a hood 18 which covers the engine compartment (not shown) of the vehicle.

Figure 2:
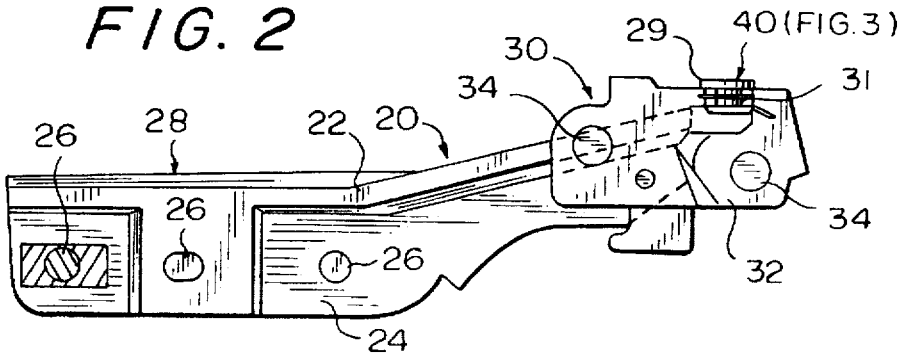
FIG. 2 is an enlarged side view of a hinge employed to hinge the hood of FIG. 1 to the load beam or other body member of FIG. 1.

Referring now to FIG. 2, there is shown a hinge 20, generally of a conventional hinge structure, which hinges the hood 18 to the load beam 14. The hinge 20 includes an arm 22 which is unitary with an attachment plate 24. The attachment plate 24 has three bolt holes 26 which receive bolts that are bolted to the hood 18. The arm 22 and plate 24 form a first component 28 of the hinge 20. The first component 28 has a first pivot hole 29 therethrough. A second component 30 of the hinge 20 includes a plate 32 which is bolted through bolt holes 34 to the load beam 14 or to some other body structure of the vehicle. The second component 30 has a pivot hole 31 therethrough. In accordance with the present invention, a conductive hinge joint assembly 40 is utilized to join the first hinge component 28 to the second hinge component 30.

Figure 3:
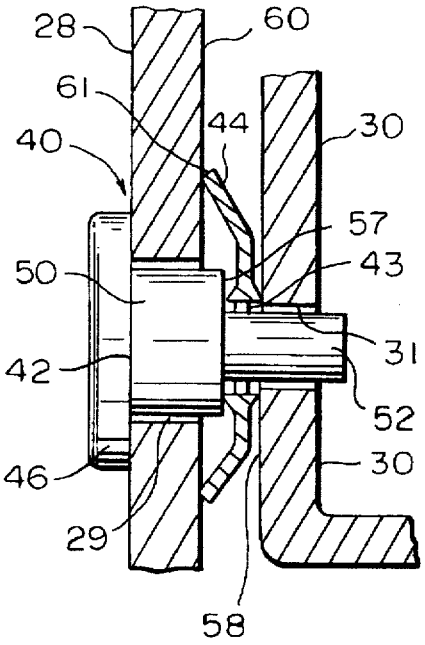
FIG. 3 is an enlarged elevational view of a washer and rivet employed in combination with the hinge of FIG. 2 prior to setting the rivet.
Figure 4:
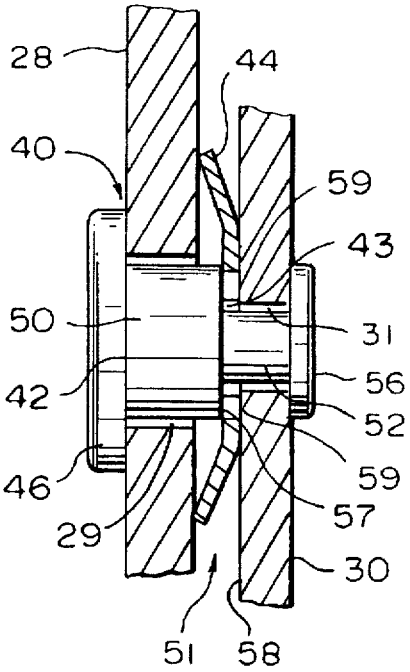
FIG. 4 is an enlarged elevational view similar to FIG. 3 but subsequent to setting the rivet.

Referring now to FIGS. 3 and 4 where a first embodiment of the hinge joint assembly 40 is shown, it is seen that the hinge joint assembly is comprised of a pin, preferably in the form of a rivet 42 which is received through the pivot holes 29 and 31 and through a center hole 43 of a conductive washer 44. The conductive washer 44 establishes a grounding path between the hinge component 28, connected to the hood 18 of the automobile (see FIG. 1) and the second hinge component 30, connected to the load beam 14 of the automobile body (see FIG. 1). FIG. 3 shows the hinge joint assembly 40 prior to the rivet 42 being set and FIG. 4 shows the hinge joint assembly after the rivet has been set.

The rivet 42 has a head 46 which is larger than the pivot hole 29 through the hinge component 28 and a stepped portion 50 which has a diameter less than the pivot hole 29 so as to be received through the pivot hole. The stepped portion 50 has an axial length slightly greater (by about 0.2 mm) than the thickness of the first hinge component 28 proximate the pivot hole 29 and a diameter less than the diameter of the pivot hole 31 through the second hinge component 30 so that when the rivet 42 is set a gap 51 (FIG. 4) remains between the first and second hinge components. A shank portion 52 of the rivet 42 projects through the second pivot hole 31 in the hinge component 30. As is shown in FIG. 4, the end of the shank 52 is set or flattened to form a head 56 having a diameter greater than the second pivot hole 31 so as to permanently join the first and second hinge components 28 and 30 to one another in a pivotal relationship. The washer 44 is slightly deformed as it is squeezed between the annular shoulder 57 and the surface 58 of the hinge member 30 so that it establishes metal-to-metal contact with the surface 58 at locations 59. Moreover, the washer 44 deflects where it contacts surface 60 of hinge member 28 and establishes metal-to-metal contact at an annular line 61. An electrical grounding path is therefore established between contact locations 61 and 57 on hinge members 28 and 30 through washer 44 effectively grounding the radio 12 to the hood 18.

In the embodiment of FIGS. 3 and 4, the rivet 42 is TEFLON® coated to provide permanent dry lubrication which will not interfere with the electrical connection between the first and second hinge components 28 and 30 provided by the washer 44.

Figure 5:
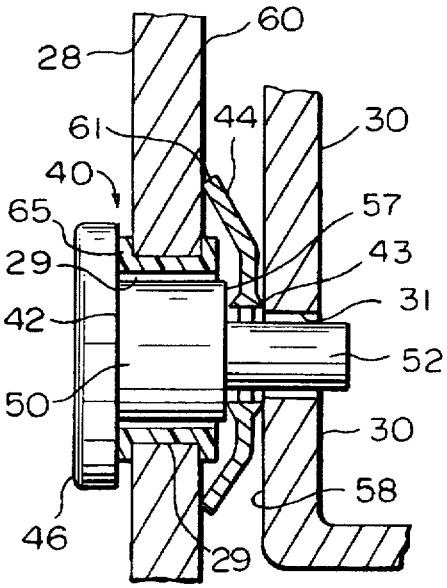
FIG. 5 is an enlarged elevational view of a second embodiment of the rivet and washer combination prior to setting the rivet.
Figure 6:
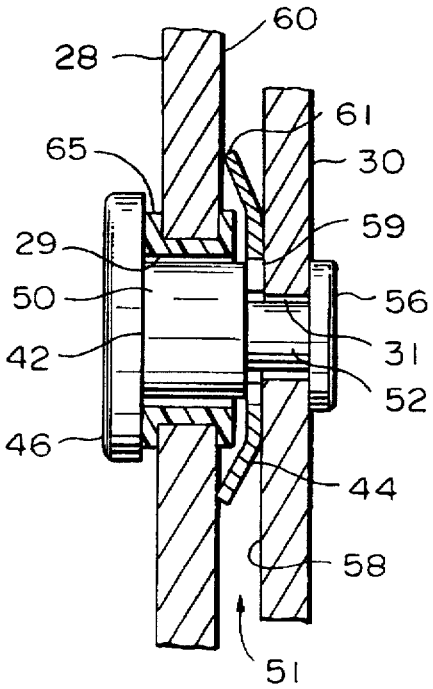
FIG. 6 is an enlarged elevational view similar to FIG. 5 but subsequent to setting the rivet.

Referring now to FIGS. 5 and 6, there is shown a second embodiment of the invention wherein, instead of coating the rivet 42 with TEFLON®, a TEFLON® bushing 65 is disposed in the hole 29 through the hinge component 28 so that the hinge component 28 rotates freely on the rivet 42. Other than the method of lubrication of the second embodiment, the second embodiment functions substantially the same as the first embodiment in which setting of the rivet 42 by forming the rivet head 56 (FIG. 6) causes deflection and stressing of the washer 44 so as to establish continuous electrical grounding through the washer due to contact between the contact locations 61 and 57.

Figure 8:
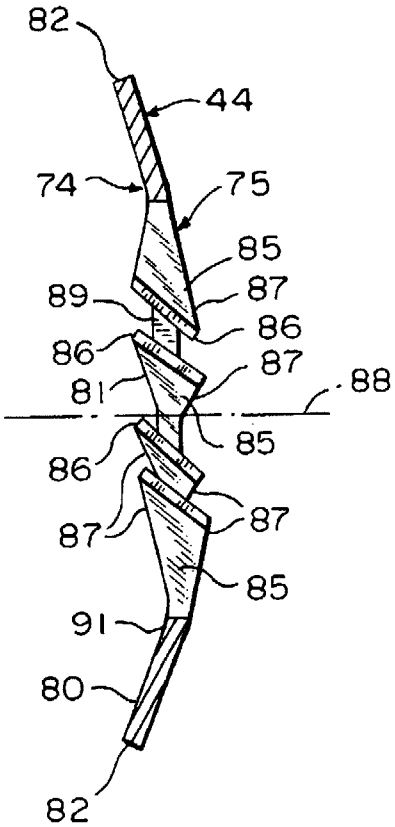
FIG. 8 is an elevation through the washer of FIG. 6 taken along lines 8—8 of FIG. 7.
Figure 7:
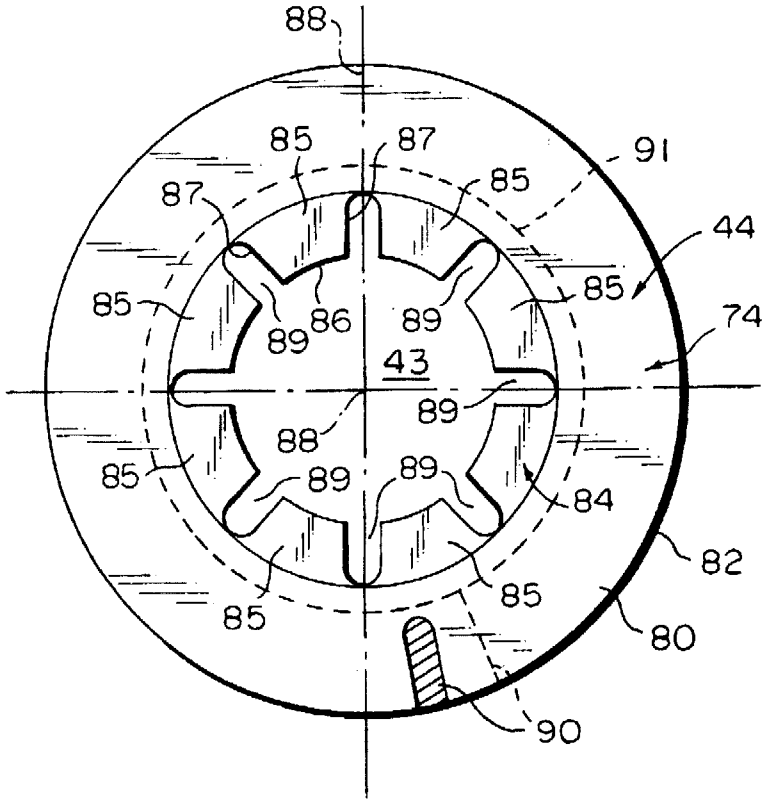
FIG. 7 is an enlarged front view of a grounding washer configured in accordance.

Referring now to FIGS. 7 and 8, the washer 44 configured in accordance with the present invention is illustrated substantially enlarged. At side 74 facing the first hinge component 28, the washer 44 is concave, and at side 75 facing the second hinge component 30, the washer is convex. The washer 44 has an outer area 80 formed as a skirt with a peripheral edge 82 for abutting the first hinge component 28 at locations 61 (see FIGS. 4 and 6) and an inner area 84 with a plurality of radially extending teeth 85 terminating in end edges 86 for abutting the second hinge component 30 at locations 59 (see FIGS. 4 and 6).

The teeth 85 are twisted or skewed about 45° so that side edges 87 thereof extend obliquely with respect to the axis 88 of the washer. The outer area or skirt 80 can have radial cuts 90 therein which facilitate bending the outer area 80 at locations 91. The bend is approximately 8°–20° and is sufficient to always place the washer 44 under a compressive load after the rivet 42 is set.

Figure 9:
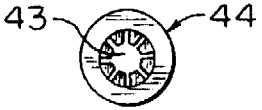
FIG. 9 is a front view of the washer of FIGS. 6–8 with the washer shown in actual size.

Preferably, the washer 44 is made of ½ hardened brass. Alternatively, the washer 44 may be made of beryllium copper or phosphor bronze. The washer 44 is about 0.25 to 0.30 mm thick, and as seen in FIG. 9, has a diameter of approximately 20.5 mm (which is the diameter of the undeformed blank).

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In an arrangement for a conductive hinge joint, the hinge joint including first and second components which are electrically connected to one another proximate pivot holes through the components, through which pivot holes a pivot pin passes, the improvement comprising:

the pivot pin being a rivet having a first head for abutting a first surface of the first hinge component and an axially spaced head for abutting a first surface of the second hinge component to hold the hinge components in pivotal relationship with respect to one another;

the rivet including a stop portion of a diameter smaller than the first head extending from the first head throughout the pivot hole toward the second head to keep the first and second components in spaced relation to one another in the first hinge component;

the rivet including a shank portion of a smaller diameter than the stop portion extending from the stop portion through the pivot hole in the second hinge component for joining the stop portion to the second head; and a conductive washer disposed around the shank portion of the rivet and between the first and second hinge components, the conductive washer being spring loaded so as to be under a constant load to maintain electrical contact between the washer and the first and second hinge components.

2. The improvement of claim 1, wherein the conductive washer includes an inner area with teeth twisted to engage both the stop portion of the rivet and the second hinge component and a concave outer area with a peripheral edge for engaging the first hinge member.

3. The improvement of claim 1, wherein the rivet is lubricated with a solid lubricant.

4. The improvement of claim 3, wherein the solid lubricant is a TEFLON® coating.

5. The improvement of claim 3, wherein the solid lubricant is a TEFLON® material of a TEFLON® grommet disposed between surfaces of the rivet and surfaces of the hinge members engaged by the rivet.

6. In an automotive vehicle having a radio and including a metal body having an engine compartment enclosed by a hood pivoted to the body with a metal hinge including a first hinge component fixed to the hood and a second hinge component fixed to the body said first and second components being electrically connected to one another proximate pivot holes through the components, through which pivot holes a pivot pin passes, the improvement comprising:

the pivot pin being a rivet having a first head for abutting a first surface of the first hinge component and an axially spaced head for abutting a first surface of the second hinge component to hold the hinge components in pivotal relationship with respect to one another;

the rivet including a stop portion of a diameter smaller than the first head extending from the first head throughout the pivot hole toward the second head to keep the first and second components in spaced relation to one another in the first hinge component;

the rivet including a shank portion of a smaller diameter than the stop portion extending from the stop portion through the pivot hole in the second hinge component for joining the stop portion to the second head;

a conductive washer having an inner portion disposed around the shank portion of the rivet and between the first and second hinge components, the conductive washer being spring loaded so as to be under a constant load to maintain electrical contact between the washer and the first and second hinge components; and wherein said inner portion is comprised of a plurality of radially extending teeth with radially extending spaces therebetween, the teeth being twisted to have edges extending obliquely with respect to the axis of the washer.

7. The improvement of claim 6, wherein the rivet is coated with TEFLON®.

* * * * *